US005573043A

United States Patent [19]

Fuehrer

[11] Patent Number: 5,573,043

[45] Date of Patent: Nov. 12, 1996

[54] CLOSURE CUP FOR A PRESSURE DISPENSER

[75] Inventor: Charles Fuehrer, Scarsdale, N.Y.

[73] Assignee: Stoffel Seals Corporation, Tuckahoe, N.Y.

[21] Appl. No.: 362,976

[22] Filed: Dec. 23, 1994

[51] Int. Cl.[6] ..... B65D 83/00

[52] U.S. Cl. ..... 141/20; 141/3; 141/82

[58] Field of Search ..... 141/2, 3, 18, 20, 141/82, 329; 53/404, 477, 489

[56] References Cited

U.S. PATENT DOCUMENTS

| | | | |
|---|---|---|---|
| 2,732,986 | 1/1956 | Whittington | 53/477 X |
| 3,140,571 | 7/1964 | Dorper et al. | 53/477 |
| 3,247,640 | 4/1966 | Miles et al. | 53/404 X |
| 4,255,916 | 3/1981 | Blankenship et al. | 53/404 |
| 4,321,953 | 3/1982 | Grothoff | 141/2 |
| 4,515,909 | 5/1985 | Sawano et al. | 523/102 |
| 5,031,384 | 7/1991 | Rebeyrolle et al. | 141/3 X |
| 5,083,415 | 1/1992 | Schneider et al. | 53/432 |
| 5,154,201 | 10/1992 | Yanagihara et al. | 137/15 |

FOREIGN PATENT DOCUMENTS

| | | | |
|---|---|---|---|
| 3737265 | 11/1987 | Germany . | |
| 3737265 A1 | 5/1989 | Germany . | |
| 0279227 | 10/1927 | United Kingdom | 53/404 |
| WO10221 | 12/1988 | WIPO . | |
| 88/10221 | 12/1988 | WIPO . | |

*Primary Examiner*—J. Casimer Jacyna

[57] ABSTRACT

A closure cup for interfused connection with a pressure dispenser. The pressure dispenser is of the type having an essentially rigid and pressure-resistant outer container made of a fusible and preferably thermoplastic synthetic organic polymer composition, such as a polyester or polycarbonate. The closure cup is made of a synthetic organic polymer composition capable of interfusion with the polymer composition of the outer container and is adapted for receiving and holding a valve assembly made up of a valve housing and a displaceable valve outlet. The closure cup is closed after pressurization of the complete dispenser structure. Such closure is capable of interfusion with the material of the closure cup so as to form a sealing closure by interfusion having substantially the same physical and chemical characteristics, notably resistance against aging and migration of the pressurizing medium, as the closure cup. This is in marked contrast with prior art closing valves or plugs made of rubber or other elastomeric materials.

16 Claims, 2 Drawing Sheets

CLOSURE CUP FOR A PRESSURE DISPENSER

BACKGROUND OF THE INVENTION

1. Field of the Invention

The present invention generally relates to the packaging art using pressurized dispensers of the type comprising an outer container and a closure member which includes a valve assembly for controlled dispensing of normally fluid substances, such as cosmetic preparations, glues, solvents, air freshening agents and the like products.

Ecological considerations and legal requirements based thereon call for replacing prior art pressurizing agents, such as halocarbons of the type known as freons, and for replacing metal containers by synthetic organic polymers capable of easy disposal or recycling. The problems of disposal or recycling became solvable with the advent of synthetic organic polymer compositions, such as polyesters including polyethylene terepthalate (PET), and polycarbonates, that can be economically processed by thermal moulding methods and yet are capable of withstanding the internal pressure needed for dispensing of the content upon operation of the valve assembly.

Pressurization, however, with relatively innocuous gaseous pressurizing media such as pressurized air, carbon dioxide, nitrogen and the like, tends to present severe problems. In particular, the use of such compressed gases leads to unusually severe criteria for the sealing quality of the pressurizable containers.

2. Prior Art

In conventional metallic dispensers pressurized with a low boiling liquid medium, such as a halocarbon of the freon type, any gaseous portion of the propellant that has escaped due to use or leakage is compensated by vaporization of liquid propel ant so that an essentially constant pressure is maintained within the dispenser. On the other hand, when using a compressed gas as propellant, a pressure reduction caused by use or leakage cannot be recompensed.

At the same time, with an increasing preference for pressure dispensers made essentially of synthetic organic polymers, sealing interconnection of the valve-carrying lid with the outer container of the dispenser became problematic and even potentially dangerous; increased inner pressure, notably in a hot environment, or careless handling of the dispenser can cause that the valve lid is explosively expelled.

Accordingly, it is known in the art to seal the connection between valve disk and outer container, or between valve disk and valve unit, with a duromeric polymer composition (also termed "thermosetting" even when crosslinking is achieved at normal temperatures). This requires specialized machinery, however, so that the dispensers must be sealed by the manufacturer of the dispenser rather than at the site where the dispenser is filled with a given product.

Pressurizable dispensers made of a synthetic polymer composition and supposed to have a mechanically safe connection between the valve-carrying closure element and the outer container yet providing for filling of the container by the distributor or manufacturer of the product in a conventional manner and at acceptable output rates are disclosed in PCT patent specification W0-88/10221 and in German patent specification DE 3 737 265.

According to W0-88/10221 the closure cup plus valve assembly is welded to the neck of a dispenser made of a synthetic organic polymer composition by means of an ultrasonic process. Attached to the valve at the inner end thereof is a flexible inner pouch in which the filled product can be stored While being hermetically sealed. The product to be filled into the dispenser is pressed through the valve into the vacuumized pouch. In a second process step, propellant is introduced through a filling element or "snorkel" which is fitted onto the valve outlet tube. For this pressurizing step a separate opening is provided which is sealed at its inner side by a sealing element or flap-valve made of an elastomeric material. Such materials tend to be susceptible to aging; upon prolonged contact with oxygen and/or upon the impact of heat they tend to become brittle and generally have a lower resistance against migration or diffusion of the pressuring medium than the material which forms the predominant part of the closure element.

Further, such sealings tend to rapidly loose their effectiveness when exposed to a dusty environment because dust particles may penetrate between the sealing element and the closure element.

DE 3 737 265 discloses a two-way valve. Here again, the product is charged, in a first process step, through the valve into an inner container; in a second process step the valve position is changed and the propellant is injected through another passage of the valve. Again, the opening for pressurizing the container is sealed with a sealing element made of an elastomeric material. Such sealings display the same drawback as described above and are unsatisfactory for pressure dispensers of this type.

A further disadvantage of both prior art dispenser discussed above resides in the fact that charging of the outer or inner container and introduction of the pressurizing medium must be carried out in separate process steps.

OBJECTS AND BRIEF SUMMARY OF THE INVENTION

Accordingly, it is a primary object of the present invention to provide a novel closure cup that avoids the drawback of prior art dispensers of the type of interest herein.

A further important object of the present invention is to provide for a novel closure cup made essentially of an organic synthetic polymer composition such that the opening for pressurization can be closed by interfusion with the polymer material to form a seal having similar physical and chemical properties as the material of which the closure cup is made.

Another object of the invention is to provide for a dispenser structure in which the outer container is made of an organic polymer composition that is capable of interfusing with the material of the closure cup.

Yet an additional object of the invention is to provide for an improved method of pressurizing a dispenser.

Further objects of the invention will become apparent as the specification proceeds.

It has been found that the above objects as well as further advantages can be achieved, according to a first general embodiment the invention, by a closure cup for interfused connection with a pressure dispenser comprising an essentially rigid and pressure resistant outer container made of a fusible synthetic organic polymer composition; the closure cup consists essentially of a synthetic organic polymer composition capable of interfusion with the outer container and being adapted for receiving and holding a valve assembly comprising a valve housing means and a displaceable valve outlet means; the closure cup comprises a sealing means capable of interfusion with said closure cup.

According to a second general embodiment the present invention provides for a pressure dispenser structure comprising an essentially rigid and pressure resistant outer container made of a fusible synthetic organic polymer composition; and a closure cup made of a synthetic organic polymer composition capable of interfusion with said outer container; the closure cup holds a valve assembly comprising a valve housing means and a displaceable valve outlet means; the closure cup comprises a pressurizing means capable of interfusion with said closure cup.

According to a third general embodiment the invention provides for a method of pressurizing a pressure dispenser having an outer container made of a fusible synthetic organic polymer composition and a closure cup made of a synthetic organic polymer composition capable of interfusion with the composition of the outer container; the closure cup has an essentially circular structure and a wall thickness sufficient for resisting an internal pressure caused by a gaseous pressurizing medium within the container while preventing significant migration or diffusion of the pressurizing medium; the method according to the invention comprises the steps of:

locally penetrating the closure cup, preferably by fusion, in an area thereof to form at least one perforation in that area;

introducing the gaseous pressurizing medium into the outer container via said at least one perforation of the closure cup for pressurizing the dispenser; and closing the perforation by interfusion of the synthetic organic polymer composition which forms the closure cup. It is preferred for many purposes to maintain, at least in the area of the at least one perforation, an external pressure which is at least equal to the internal pressure of the dispenser until solidification of the interfused synthetic organic polymer composition which closes the perforation.

DEFINITION OF TERMS AND PREFERRED EMBODIMENTS OF THE INVENTION

The term "closure cup" is used herein in analogy with the conventional term "valve cup" except that the valve unit is not considered to be a necessary component of the closure cup; however, a closure cup according to the invention may be manufactured to include the valve unit which, in turn, is a necessary component of a dispenser structure according to the invention. An "essentially rigid and pressure resistant outer container" is "rigid" as opposed to "pliable" or "foldable", the latter terms being a characteristic of inner containers or pouches used in some types of dispensers; further, the outer container is "pressure resistant" in the sense of satisfying industrial or governmental standards for containers that include a pressurizing medium or propellant under elevated pressures and are admitted for use under household conditions.

Typical pressures are in the range of from about 2 to about 20 bars depending upon the application; the upper limit will, of course, depend upon the material used, the wall thickness and the maximum temperature of exposure. Thus, neither lower nor Upper limit given above is considered critical.

The terms "fusion" and "interfusion" are used herein to encompass "melting" and "intermelting" but further encompass any state in which two constituents can be interconnected to form a bond which is essentially as firm as one of the individual components; accordingly, "fusion" is intended to include reaching a plastified state in which two components can be interwelded with each other, e.g. upon the impact of pressure and preferably but not necessarily implying heating to a temperature at which fusion occurs.

By the same token, a "synthetic organic polymer composition" for use according to the invention is a composition which contains, at least as a predominant portion, an organic macromolecular substance of the type exemplified by the preferred thermoplastic polyesters including PET, polycarbonates, and the like. Other thermoplastic polymers including polyamides or polyacrylics having the required tenacity and being capable of fusion are mentioned as further examples. As implied by the term "composition" this includes but is not restricted to essentially pure polymers, copolymers, graft copolymers as well as mixtures thereof with conventional additives for stabilization, processing, colouring, fillers and the like. Transparent thermoplastic polymers suitable for the invention an preferred for various purposes with the required tenacity and other properties needed for use in dispensers are obtainable commercially and in commercial quantities.

According to a preferred embodiment of the invention the closure cup is an essentially circular structure made of a polymer composition capable of interfusion with itself and, preferably, with the outer container. For many purposes of the invention it is preferred that the material of the closure cup and that of the outer container should be similar enough to enable interwelding by thermal methods, such as frictional welding, ultrasonic welding, high-frequency welding and the like. Shape and, notably, the wall thickness of the closure cup must be sufficient to resist the pressure caused by the pressurizing medium within the outer container.

In a preferred general embodiment the closure means of a closure cup comprises a site where the wall thickness of the closure cup is reduced in a first area (so as to produce a local deficit of fusible material), and increased in a second area (so as to produce a local surplus of fusible material) immediately adjacent the first area so as to permit closure of and interfusion with the first area when the second area is subjected to conditions sufficient for fusion of said second area. Preferably, the first area is a recess in or perforation of the wall of the closure cup with a maximum diameter that is relatively small (in relation to the cup's main dimensions) and preferably does not exceed the wall thickness of the closure cup.

The reason for providing such a site of adjacent areas of deficit and surplus of fusible material, respectively, is that deficit and surplus can be mutually compensated by interfusion once the pressurizing medium has been introduced into the outer container. Optimum conditions are obtained if the material surplus in the second area at least about equals the material deficit in the first area; in this case the mechanical and chemical properties of the area resulting from interfusion will be similar if not equal to those of the adjacent areas and the rest of the closure cup. A surplus surpassing the deficit so as to form a protrusion or bead on either or both sides of the closure cup is not detrimental.

Local heating of the surplus area and, preferably, of the adjacent surface in the deficit area can be effected by means of a heated metal element (which may be massive, or may be hollow if also serving for introduction of the pressurizing medium). Preferably, an area of local overpressure is generated temporarily at the outside to compensate the pressure inside the dispenser so as to prevent that the interfusing material is blown out of the perforation or recess before solidification. A gasket or pressurizing bell communicating with the source of the pressurizing medium or with the interior of the dispenser can be used for that purpose.

While a closure cup according to the invention may have more than one site of adjacent areas of deficit and surplus of fusible material, use of a single such site is suitable for many purposes of the invention. By the same token, while at least one perforation of the closure cup is formed when performing the method according to the invention, forming of a single perforation is suitable and provides for simple operation.

The valve housing may be interconnected, e.g. by providing a matching pair of retaining sleeves, with the closure cup and such interconnection may include material interfusion at interface areas; further, an inner collapsible pouch, or inner container, may in turn be sealingly connected with the valve housing.

Sealing connection between closure cup and outer container in a dispenser structure according to the invention can be achieved by various joining methods, preferably by welding interconnection, such as can be achieved by conventional friction welding, ultrasonic welding and similar methods.

If the closure cup is to be connected with the outer container by friction welding, the closure cup can be provided with one or more stopper faces for engagement with a drive that rotates the closure cup relative to the outer container. In a similar manner, the valve disk of the valve arrangement may contain means for rotating the valve disk if friction welding is to be used for purposes of assembly.

The valve disk, in, turn, preferably has a simple structure such that it can be produced by injection moulding for easy adaption to specific requirements of the user; preferably, it's structure is such as to enable production by simple shaping or moulding methods, such as injection moulding. Such considerations of shaping and production also apply to preferred structures of a closure cup according to the invention.

It is an advantage of the invention that the product can be filled via the valve into the outer container while pressurizing medium is fed into the container via the interfusible sealing means; this is of particular advantage when an additional inner container or pouch is provided.

The present invention also compares advantageously with known sealing devices as regards process steps and economy. Different product manufacturers, each having their own specific machinery, can use the invention without costly changes of their equipment and filling methods. For example, the product can be filled conventionally and the container can subsequently be sealed and pressurized. On the other hand, the present invention also permits the packaging industry to deliver pre-sealed and pre-pressurized containers to the product manufacturers, and these need only to charge the container with the product through the valve. Also, the invention can be utilized in connection with charging techniques with under-cup pressurizing.

BRIEF EXPLANATION OF THE DRAWINGS

Preferred embodiments of the present invention will be described for purposes of illustration and not limitation with reference to the attached drawings in which.

DETAILED DISCUSSION OF THE ILLUSTRATED EMBODIMENTS

Figure 1:
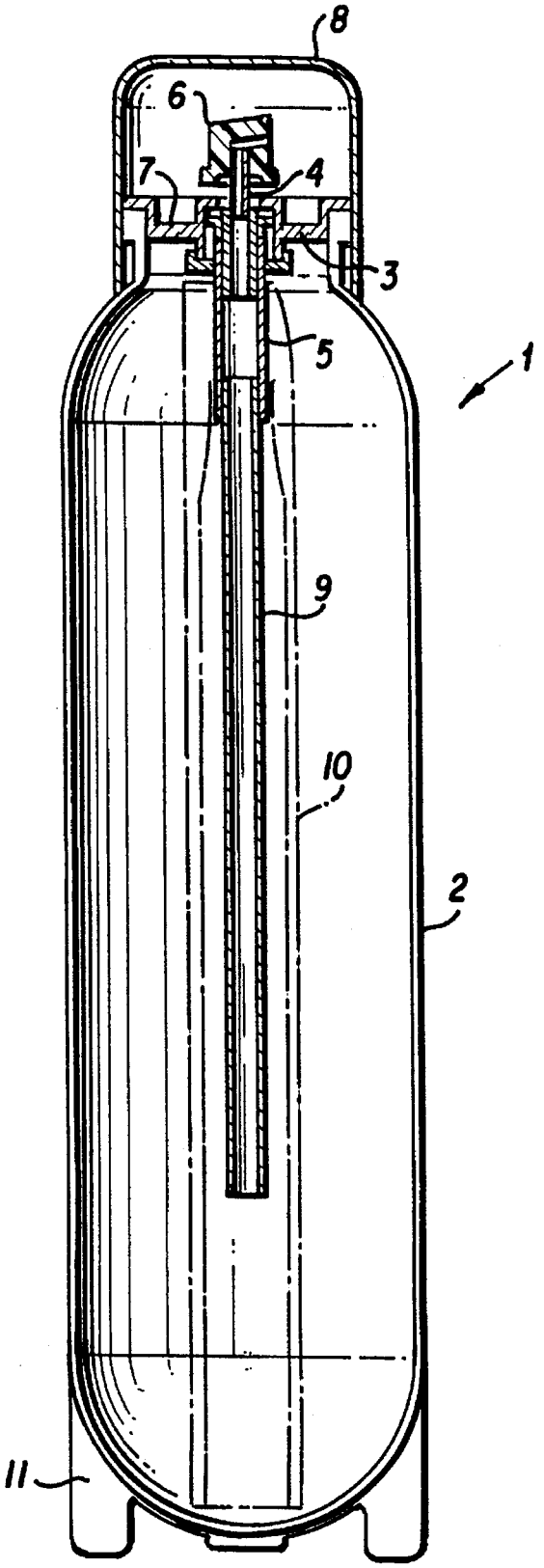
FIG. 1 is a schematic cross-sectional view of a dispenser structure including a closure cup according to the invention.

The dispenser structure 1 shown in FIG. 1 comprises a pressurizable outer container 2 made of a thermoplastic organic polymer composition, such as PET. Closure cup 3 is sealingly connected with container 2, e.g. by rotational or ultrasonic welding. Closure cup 3 consists of a polymer composition capable of interwelding with the outer container 2 and includes a valve assembly comprising a valve outlet tube 4, a valve housing 5 and a nozzle 6. So far, the structure is conventional.

According to the invention, closure cup 3 is provided with a sealing means comprising a small perforation 7 in the wall of closure cup 3 and an annular protrusion surrounding said perforation. Details of the perforation and the protrusion or bulge 24 are apparent more clearly from FIG. 2.

The remaining components of the dispenser structure shown in FIG. 1 are conventional and include a cap 8, a dip tube 9, an inner container or pouch 10, and a support 11.

Figure 2:
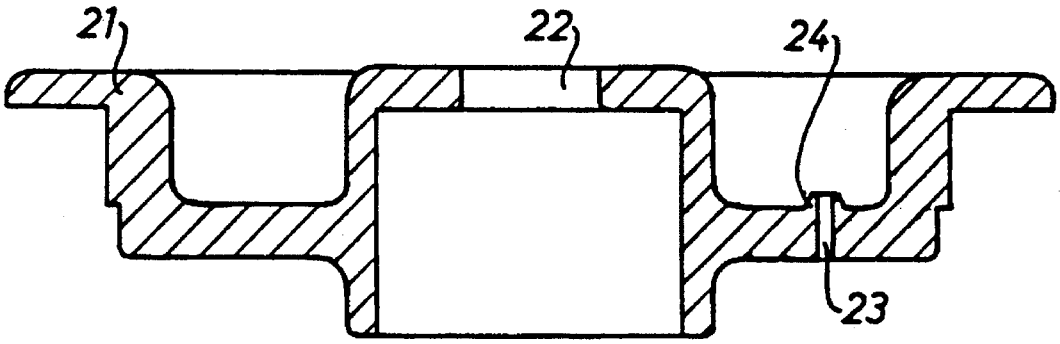
FIG. 2 is a schematic cross-sectional view showing a first embodiment of a closure cup according to the invention.
Figure 3:
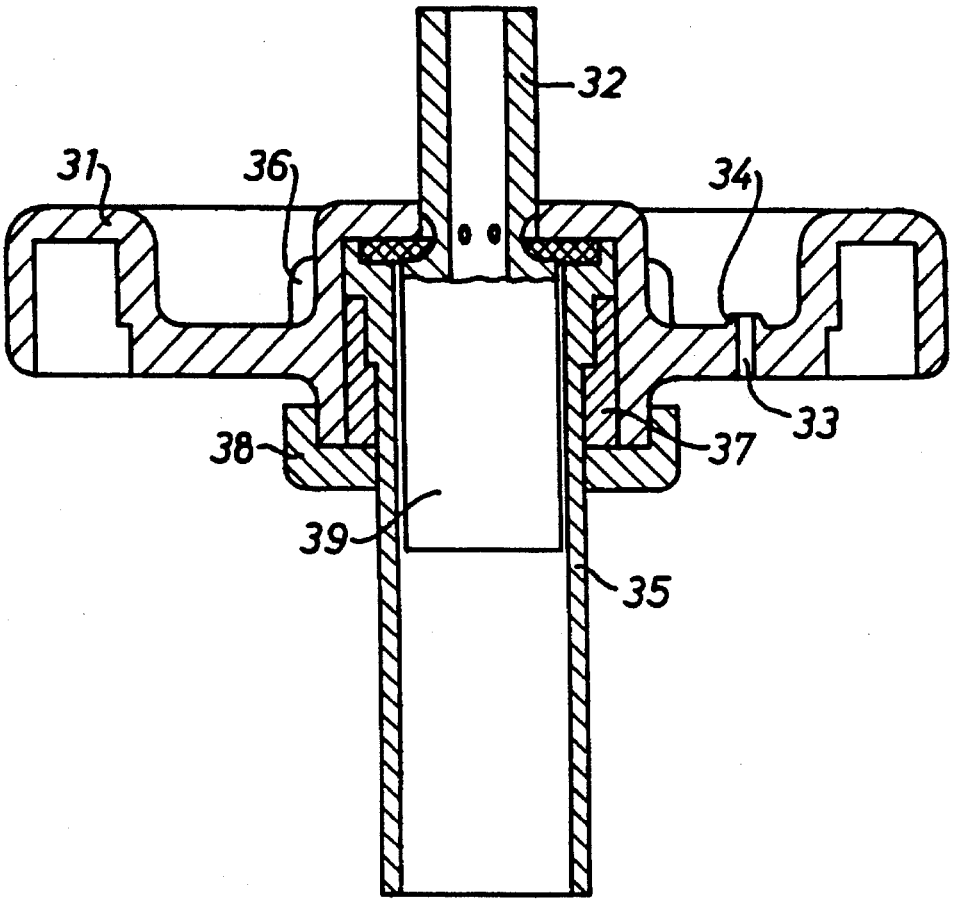
FIG. 3 is a schematic cross-sectional view showing another embodiment of a closure cup according to the invention.

The cross-sectional view of an enlarged presentation of a closure disk according to the invention presented in FIG. 2 shows conventionally stepped side flanges for interwelding with an outer container (not shown in FIG. 2). A central hub for receiving and holding-a valve assembly (c.f. FIG. 3) is provided with an opening 22 for passage of the upper portion of a valve assembly (not shown in FIG. 2). Viewed from top or bottom, the closure cup presented in FIG. 2 would show an essentially circular shape.

The wall that interconnects the central hub with the lateral flanges is provided with a perforation or bore 23 surrounded at it's upper end by an annular protrusion or bulge which is an integral part of the closure cup shown in FIG. 2 and consists of the same polymer composition as its other parts. Preferably, the closure cup is shaped by a thermal moulding method, such as injection moulding, pressure moulding; die moulding etc..

FIG. 3 illustrates an assembly of a closure cup 31 according to the invention essentially as shown in FIG. 2 except that the lateral flanges are shaped in the manner of an inverted "U" for double-sided engagement with an outer container (not shown in FIG. 3). Valve housing 35 including a conventional valve structure is secured to the central hub portion of closure cup 31 by means of an intermatching pair of sleeves, i.e. inner retaining sleeve 37 and outer retaining sleeve 38. Valve outlet tube 32 extends upwardly through an opening of the hub portion of closure cup 31.

A pair of outer stop faces 36 is provided for connection with the drive of a friction welding device (not shown). Bore or perforation 33 with as diameter of less than the wall thickness of closure cup 31, e.g. with an inner diameter corresponding to about 10 to 50% of the wall thickness, is surrounded at it's upper end by an annular protrusion 34 consisting of the same polymer composition as closure cup 31. ****

A preferred method according to the invention operates as follows:

closure cup 7 (FIG. 1) including a valve assembly (FIG. 3) and outer container 2 are interconnected by welding, e.g. by friction welding or ultrasonic welding;

gaseous pressurizing medium, e.g. elemental nitrogen, is introduced into the space between the inner wall of external container 2 (FIG. 2) and the outer wall of the inner container or pouch 10 (if present); introduction is effected through perforation 33 by means of a hollow needle (not shown);

annular protrusion 34 (FIG. 3) is heated to a temperature above it's fusion point, e.g. to a temperature in the range between 200° and 250° C., e.g. by a heated needle which may be but need not be the hollow needle used for introduction of the pressurizing medium; at the same time, a gasket is placed onto the outer side of closure cup 7 and a pressure is generated between the gasket and closure cup substantially compensating the pressure within container 2. When the fused polymer composition produced by heating the annular protrusion has interfused with the inner wall of perforation 33 and become solid by termination of heating, the external pressure is removed.

The pressurized dispenser is now firmly sealed by interfusion of the perforation resulting in an essentially homogeneous bonding area that consist of the same polymer material as the closure gap and permits prolonged storing without significant loss of the pressurizing medium.

Alternatively, propellant is introduced via a perforation of the closure cup formed in situ, e.g. by fusion, such as by penetration of the closure cup of the dispenser structure with a hot needle; such needle my be hollow and serve to introduce the propellant; Again, application of an external pressure to compensate for the internal pressure is preferred and mechanical shaping means may be used to force fused material of the closure cup into the perforation for closure thereof by interfusion and subsequent solidification.

Various modifications of embodiments depicted and explained above for purposes of illustration and not of limitation will be apparent to those skilled in the art.

Accordingly, what is claimed is :

1. A closure cup for interfused connection with a pressure dispenser comprising an essentially rigid and pressure resistant outer container made of a fusible synthetic organic polymer composition; said closure cup consisting essentially of a synthetic organic polymer composition capable of interfusion with said outer container and being adapted for receiving and holding a valve assembly comprising a valve housing means and a displaceable valve outlet means; said closure cup comprising a sealing means capable of forming a permanent closure of an opening of said closure cup by interfusion.

2. The closure cup of claim 1 formed essentially of an integrally moulded circular structure having a wall thickness sufficient for resisting a pressure caused by a pressurizing medium within said container while preventing significant migration of said pressurizing medium; wherein said sealing means comprises at least one site where said wall thickness is reduced in a first area to provide for a deficit of wall-forming material, and increased in a second area immediately adjacent said first area to provide for a surplus of wall-forming material so as to permit closure of and interfusion with said first area when said second area is subjected to conditions sufficient for fusion of said second area.

3. The closure cup of claim 2 wherein said first area is formed by an essentially cylindrical recess having a maximum diameter that does not exceed said wall thickness; and wherein said second area is formed by a protruding circular mass of said synthetic organic polymer of said closure cup integrally connected with said wall thereof and surrounding said recess at an outer surface of said closure cup.

4. The closure cup of claim 2 wherein said first area is formed by an essentially circular perforation having a maximum diameter that does not exceed said wall thickness; and wherein said second area is formed by a bulge surrounding said perforation at an outer surface of said closure cup; said bulge having a sufficient mass to fumingly close said perforation upon application of fusion conditions.

5. The closure cup of claim 1 wherein said valve housing is interfused with said closure cup.

6. The closure cup of claim 1 wherein an inner collapsible pouch is sealingly connected with said valve housing.

7. A pressure dispenser structure comprising an essentially rigid and pressure resistant outer container made of a fusible synthetic organic polymer composition; and a closure cup made of a synthetic organic polymer composition capable of interfusion with said outer container; said closure cup holding a valve assembly comprising a valve housing means and a displaceable valve outlet means; said closure cup comprising a pressurizing means capable of sealing by interfusion with said closure cup.

8. The dispenser structure of claim 7 wherein said closure cup is formed essentially of an integrally moulded circular element having a wall thickness sufficient for resisting a pressure caused by a pressurizing medium within said container while preventing significant migration of said pressurizing medium; and wherein said sealing means comprises at least one site where said wall thickness is reduced in a first area and increased in a second area immediately adjacent said first area so as to permit closure of and interfusion with said first area when said second area is subjected to conditions sufficient for fusion of said second area.

9. The dispenser structure of claim 8 wherein said first area of said closure cup is formed by an essentially cylindrical recess having a maximum diameter that does not exceed said wall thickness of said closure cap; and wherein said second area is formed by a protruding circular mass of said synthetic organic polymer of said closure cup integrally connected with said wall thereof and surrounding said recess at an outer surface of said closure cup.

10. The dispenser structure of claim 8 wherein said first area of said closure cup is formed by an essentially circular perforation having a maximum diameter that does not exceed said wall thickness; and wherein said second area is formed by a bulge surrounding said perforation at an outer surface of said closure cup; said bulge having a sufficient mass to fumingly close said perforation upon application of fusion conditions.

11. The dispenser structure of claim 7 wherein an inner collapsible pouch is sealingly connected with said valve housing.

12. The dispenser structure of claim 7 wherein said closure cup is made of substantially the same organic synthetic polymer composition as said outer container.

13. The dispenser structure of claim 12 wherein said organic synthetic polymer composition is a normally transparent thermoplastic polymer composition in which the main constituent is selected from thermoplastic polyesters and thermoplastic polycarbonates.

14. The dispenser structure of claim 7 wherein said closure cup comprises at least one external stopper face for engagement with a drive and for rapid rotation of said closure cup relative to said outer container for connecting the latter with said closure cup by rotation welding.

15. A method of pressurizing ia pressure dispenser having an outer container made of a fusible synthetic organic polymer composition, a closure cup made of a synthetic organic polymer composition capable of interfusion with said composition of said outer container and a valve assembly; said closure cup being a circular structure having a wall thickness sufficient for resisting an internal pressure caused by gaseous pressurizing medium within said container while preventing significant migration of said pressurizing medium; said method comprising the steps of:

locally penetrating said closure cup in an area thereof to form at least one perforation in said area;

introducing said gaseous pressurizing medium into said outer container via said at least one perforation of said closure cup for pressurizing said dispenser;

closing said perforation by interfusion of said synthetic organic polymer composition forming said closure cup; and interfusingly connecting said closure cup and said valve assembly to said outer container by thermal welding.

16. The method of claim 15, wherein said thermal welding step is selected from the group of welding methods consisting of friction welding, ultrasonic welding and microwave welding.

* * * * *